United States Patent [19]

Binder

[11] 3,955,243

[45] May 11, 1976

[54] APPARATUS FOR RECEIVING A SILVER CAN AND FOR CONTROLLING THE QUANTITY OF MATERIAL DEPOSITED THEREIN

[75] Inventor: Rolf Binder, Raterschen, Switzerland

[73] Assignee: Rieter Machine Works, Ltd., Winterthur, Switzerland

[22] Filed: Sept. 24, 1974

[21] Appl. No.: 508,862

[30] Foreign Application Priority Data

Oct. 10, 1973 Switzerland ..... 14414/73

[52] U.S. Cl. ..... 19/.2; 19/159 R; 141/83; 177/208; 177/254

[51] Int. Cl.[2] ..... D01G 31/00; B65H 54/76

[58] Field of Search ..... 19/157, 159 R, 159 A, 19/239, 240, 241, .2; 53/162, 163; 214/6 H; 200/85 R; 177/208, 254; 141/83, 351

[56] References Cited

FOREIGN PATENTS OR APPLICATIONS

| | | | |
|---|---|---|---|
| 9,739 | 1891 | United Kingdom | 19/.2 |
| 173,641 | 12/1965 | U.S.S.R. | 19/159 R |

*Primary Examiner*—Dorsey Newton
*Attorney, Agent, or Firm*—Kenyon & Kenyon Reilly Carr & Chapin

[57] ABSTRACT

The turntable on which the silver can is mounted is connected to a piston of a compressed air cylinder and air pressure is used to maintain the piston and table in preset positions. When the silver can is filled to the preset weight, the table and piston move downwardly to activate either a switch in the path of the piston or a pressure responsive switch in the air line to the pressure side of the air cylinder.

7 Claims, 3 Drawing Figures

APPARATUS FOR RECEIVING A SILVER CAN AND FOR CONTROLLING THE QUANTITY OF MATERIAL DEPOSITED THEREIN

This invention relates to an apparatus for receiving a sliver can and for controlling the quantity of sliver material deposited therein.

Heretofore, various types of devices have been known for depositing sliver into sliver cans in a controlled manner. In some instances, use has been made of a table which is connected to a piston and supported by a compression spring which encircles the piston. In operation, as the sliver can fills with material, the table descends while compressing the spring in accordance with the weight of the can and the can contents. As a filled can is removed, the table springs back to its initial position.

Generally, if a determined can weight is exceeded while the can is being filled, the piston is lowered over a certain normal lift length and activates a switching element for signalling the overweight to a certain point or control device. Since the sliver cans are shifted onto or shifted away from the can table during a can change operation and since the turntable is normally located at the same height level as a surrounding platform for taking up the empty and full cans, the length of lift for activating the switching element has to be very small. That is, the length of lift must be such that shifting of the full can onto the platform is not prevented by too low a position of the can table.

A disadvantage of a device of this type is that an appropriate spring must be chosen according to the can weight desired in such a manner that approximately uniform lengths of lift are obtained at different can weights.

A further disadvantage is that lifting and lowering of the can table in excess of the above mentioned length of lift, e.g. for centering a can shifted onto the turntable by lifting an upper part of the can table into the bottom part of the can, cannot be effected or can be effected only if a complicated mechanism is used.

Accordingly, it is an object of the invention to provide an apparatus which permits quick and simple adaption of a control device to the can weight and which permits lifting and lowering of the can table in excess of the necessarily small lift for the weight control by simple additional devices.

It is another object of the invention to provide an apparatus for accurately controlling the filling of sliver material into sliver cans.

It is another object of the invention to rapidly remove a filled sliver can from a filling and weighing apparatus.

Briefly, the invention provides an apparatus for receiving a sliver can and for controlling the quantity of sliver deposited contained in the can. The apparatus comprises a table for receiving a sliver can, a means for yieldingly supporting the turntable and switching elements responsive to a preset quantity of material deposited in the can for stopping continued delivery of material to the can. The means for yieldingly supporting the turntable includes a compressed air cylinder, a piston slidably mounted in the cylinder and connected to the table, and a means for establishing the air pressure in the cylinder.

In one embodiment, the means for establishing the air pressure in the cylinder utilizes a pressure reduction valve. In another embodiment, the means for controlling the air pressure uses a pressure reduction valve and a switch valve which serves to cause a lifting of the piston in the compressed air cylinder.

The switching element can be in the form of a switch in the path of movement of a piston rod of the piston. In this embodiment, the switch is responsive to a preset movement of the piston rod which movement corresponds to a weight of material in the sliver can sufficient to overcome the force of the air pressure in the cylinder on the piston. The switching element can also be a pressure responsive switch connected between the means for establishing the air pressure in the cylinder and the air cylinder. This pressure responsive switch is set to respond to an increase in air pressure within the cylinder in excess of the preset air pressure.

These and other objects and advantages of the invention will become more apparent from the following detailed description and appended claims taken in conjunction with the accompanying drawings in which:

Figure 1:
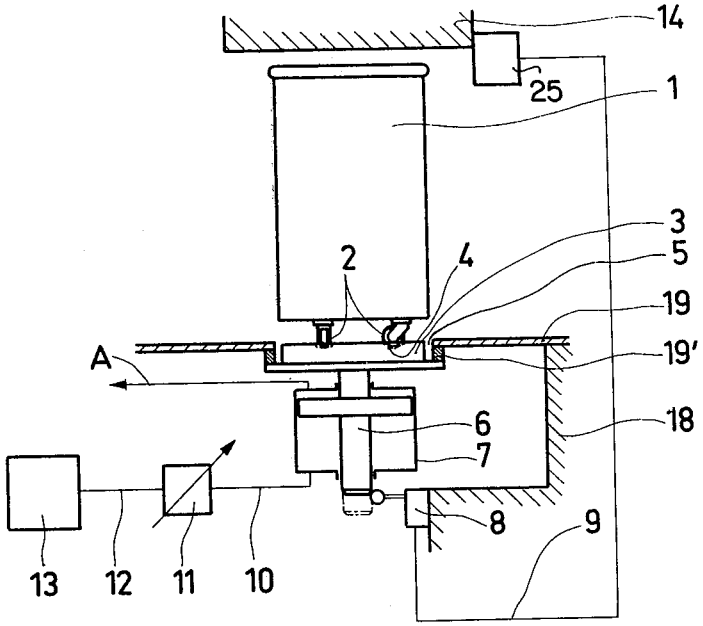
FIG. 1 illustrates a schematic view of a sliver can mounted on a turntable of an apparatus according to the invention.

Referring to FIG. 1, a sliver can 1 for receiving sliver material includes a plurality of transporting wheels 2 by which the can 1 is moved from place to place. The apparatus for receiving the sliver can 1 and for controlling the quantity of sliver material contained in the can 1 includes a table 3 for receiving the can 1, a means for yieldingly supporting the table 3 and a switching element 8 which is responsive to a preset quantity of material deposited in the can in order to stop continued delivery of material to the can 1.

The table 3 is formed with a number of recesses 4 which receive the wheels 2 of the can 1 in order to center the can 1 on the table. As shown, the table 3 is mounted within an opening 5 of a platform 19 mounted on a machine frame 18 and is disposed to move vertically.

The means for yieldingly supporting the table includes a compressed air cylinder 7, a piston slidably mounted in the cylinder 7 and connected via a piston rod 6 to the table 3 and a means for establishing the air pressure in the cylinder 7. This latter means includes a pressure duct 10 which communicates the pressure side of the cylinder 7, that is, the side opposite the table 3, with a pressure reduction valve 11 which in turn is connected via a pressure duct 12 with a suitable pressure source 13. The upper end of the cylinder 7, i.e. the end facing the can table is connected with the surrounding room in which atmospheric pressure prevails, which is indicated by an arrow A.

The switching element 8 is mounted on the machine frame 18 below and in the path of movement of the piston rod 6. This switching element 8 is in the form, for example, of an electrical limit switch which is connected via a circuit 9 to a control unit 25.

A conventional sliver feeding device 14 such as a coiler is positioned above the table 3 and can 1 to deliver sliver material to the can 1 in any suitable fashion. The feed action of this feeding device 14 is controlled by the control unit. As such, the feeding action of the device 14 can be stopped by the switching element 8 since the element 8 is connected to the device feeding 14 via the control unit 25.

During normal operation, i.e. while the sliver can 1 is being filled by the sliver feeding device 14, the can table 3 is pressed against an annular stop 19' adjoined to the platform 19 by the pressure prevailing in the cylinder 7 and preset by means of the pressure reduction valve 11. As a determined quantity of material is exceeded while the can 1 is being filled, the force generated by the cylinder 7 and dependent on the pressure preset on the pressure reduction valve 11 is exceeded to such an extent that the piston rod 6 is lowered. As a result, the switching element 8 is activated to transmit a signal from the switching element 8 to the control unit 25 in order to stop the feed action of the feeding device 14. The filled can 1 can then be moved off the table 3 onto the platform 19 and another can moved onto the table 3 for filling. During this time, the pressure in the cylinder 7 returns the table 3 to the initial position, i.e. flush with the platform.

Figure 2:
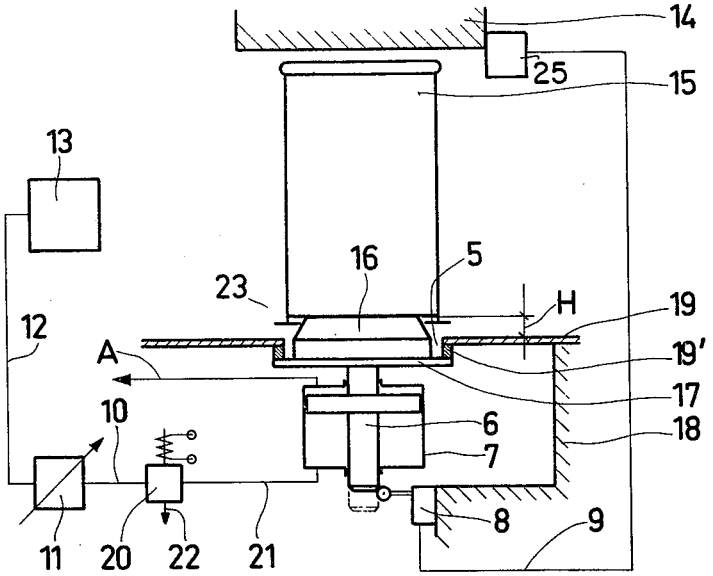
FIG. 2 illustrates a schematic view of a modified apparatus according to the invention.

Referring to FIG. 2, wherein like reference characters indicate like parts as above, the apparatus for receiving a sliver can 15 with an annular rim 23 includes a table 17 having a raised upper part 16 for centering the sliver can 15. As above, the table 17 is connected via a piston rod 6 to a piston of a compressed air cylinder 7 and the piston rod 6 is disposed to activate a switching element 8 upon moving downwardly. The means for establishing the pressure in the cylinder 7 includes a pressure duct 21 which communicates the cylinder 7 with a switch valve 20 which in turn is connected via the pressure duct 10 with the pressure reduction valve 11. Also, the reduction valve 11 communicates via a duct 12 with a pressure source 13. A drain duct 22 of the switch valve 20 is connected with the surrounding room in which atmospheric pressure prevails.

In operation, the sliver can 15 is shifted onto the platform 19 in such manner that the annular rim 23 of the sliver can 15 covers the upper part 16 of the can table 17. Subsequently, the switch valve 20 is activated by a control unit (not shown) in such a manner that the ducts 10 and 21 are connected and the compressed air cylinder 7, lifting the piston rod 6 over the lift distance H, inserts the upper part 16 of the can table 17 within the rim 23 thus centering the sliver can 15. As the sliver can becomes overfilled, the switching element 8 is activated in analogy to the manner described above by the piston rod 6 such that the filling operation is interrupted.

Figure 3:
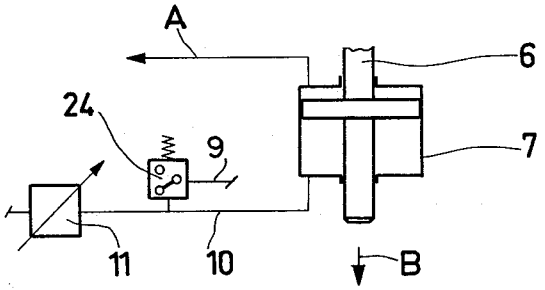
FIG. 3 illustrates a schematic view of a modified switching element according to the invention.

Referring to FIG. 3, wherein like reference characters indicate like parts as above, instead of using a mechanically activated switching element 8 as shown in FIG. 1, a pressure responsive switch 24 can be used. In this case, the switch 24 is connected to the pressure duct 10. In operation, when the piston 6 is moved in the direction indicated by the arrow B, the pressure in the duct 10 increases as the pressure reduction valve 11 acts as a non-return valve. As a result, the pressure switch 24 is activated and transmits a signal to the control unit to cause interruption of the action of the sliver feeding device 14 as illustrated in FIG. 1.

The pressure switch 24 can be connected in analogous manner with the apparatus shown in FIG. 2.

The apparatus can also be used with a rotating turntable with corresponding guide elements available on the market being incorporated between the piston rod 6 and the can table 3 or 17 respectively, as well as between the can table 3 or 17 respectively, and the platform 19.

The invention thus provides an apparatus for receiving a sliver can and for controlling the quantity of material deposited in the can which permits a simple adaption of the filling quantity control to the sliver can weight. In addition, the apparatus allows a simple combination of the filling quantity control and of the vertical movement of the can table for centering the can.

What is claimed is:

1. An apparatus for receiving a sliver can and for controlling the quantity of material contained in the sliver can comprising a table for receiving a sliver can thereon;

means for yieldingly supporting said table including a compressed air cylinder, a piston slidably mounted in said cylinder and connected to said table, and a means for establishing the air pressure in said cylinder on the underside of said piston;

a sliver feeding device for delivering sliver to said can; and a switching element connected to said sliver feeding device and responsive to a downward movement of said table and piston resulting from a preset quantity of material deposited in the sliver can for stopping continued delivery of material to the sliver can from said sliver feeding device.

2. An apparatus as set forth in claim 1 wherein said means for establishing the air pressure in said cylinder is a pressure reduction valve.

3. An apparatus as set forth in claim 1 wherein said means for establishing the air pressure in said cylinder includes a pressure reduction valve and a switch valve for generating a lift of said piston rod in said cylinder.

4. An apparatus as set forth in claim 1 wherein said switching element is a pressure-responsive switch connected to the pressure side of said compressed air cylinder.

5. In an apparatus for receiving a sliver can, the combination comprising a table for receiving a sliver can;

a sliver feeding means for feeding sliver material to the sliver can;

means for yieldingly supporting said table including an air cylinder, a piston slidably mounted in said cylinder and having a piston rod connected to said table to follow vertical movements of said table upon filling of a sliver can on said table with sliver material, and a means for establishing a preset air pressure in said cylinder on the underside of said piston; and an element in the path of movement of said piston rod responsive to a preset downward movement of said piston rod to stop continued delivery of material from said feeding means to the sliver can, said preset movement corresponding to a weight of material in the sliver can sufficient to overcome the force of said air pressure in said cylinder on said piston.

6. In an apparatus as set forth in claim 5 wherein said element is a switch connected to said feeding means to interrupt feeding of sliver material to the sliver can in response to said preset movement of said piston rod.

7. In an apparatus for receiving a sliver can, the combination comprising a vertically movable table for receiving a sliver can;

a sliver feeding means for feeding sliver material into a sliver can on said table;

means for yieldingly supporting said table in a vertical plane, said means including an air cylinder, a piston slidably mounted in said cylinder and having a piston rod connected to said table to follow vertical movements of said table upon filling of a sliver can on said table with material, and a means for establishing a preset air pressure in said cylinder on the underside of said piston, said preset air pressure corresponding to a predetermined weight of material in the sliver can; and a pressure responsive switch connected between said means for establishing the preset air pressure and said air cylinder to respond to an increase in air pressure within said cylinder in excess of said preset air pressure, said pressure responsive switch being connected to said feeding means to interrupt feeding of sliver material to the sliver can in response to activation of said switch.

* * * * *

UNITED STATES PATENT AND TRADEMARK OFFICE

CERTIFICATE OF CORRECTION

PATENT NO. : 3,955,243

DATED : May 11, 1976

INVENTOR(S) : Rolf Binder

It is certified that error appears in the above-identified patent and that said Letters Patent are hereby corrected as shown below:

In the Title, change "silver" to --sliver--.

In the Abstract, line 1, change "turntable" to --table--.
line 1, change "silver" to --sliver--.
line 4, change "silver" to --sliver--.

Column 1, line 56, delete "contained".

Column 1, line 62, delete "turntable" and insert --table--.

Column 3, line 59, after "unit" insert --25--.

Signed and Sealed this

Seventh Day of September 1976

[SEAL]

*Attest:*

RUTH C. MASON
*Attesting Officer*

C. MARSHALL DANN
*Commissioner of Patents and Trademarks*